US007321348B2

(12) United States Patent
Cok et al.

(10) Patent No.: US 7,321,348 B2
(45) Date of Patent: Jan. 22, 2008

(54) OLED DISPLAY WITH AGING COMPENSATION

(75) Inventors: Ronald S. Cok, Rochester, NY (US); Thomas Niertit, Webster, NY (US); Andrew D. Arnold, Hilton, NY (US)

(73) Assignee: Eastman Kodak Company, Rochester, NY (US)

( * ) Notice: Subject to any disclaimer, the term of this patent is extended or adjusted under 35 U.S.C. 154(b) by 517 days.

(21) Appl. No.: 10/712,337

(22) Filed: Nov. 13, 2003

(65) Prior Publication Data

US 2004/0070558 A1 Apr. 15, 2004

Related U.S. Application Data

(63) Continuation-in-part of application No. 09/577,241, filed on May 24, 2000, now abandoned.

(51) Int. Cl.
*G09G 3/32* (2006.01)

(52) U.S. Cl. ..... 345/82; 345/208; 345/211

(58) Field of Classification Search ..... 345/82, 345/211, 206, 81, 87
See application file for complete search history.

(56) References Cited

U.S. PATENT DOCUMENTS 4,751,659 A 6/1988 Hecht
4,769,292 A 9/1988 Tang et al.
5,019,807 A * 5/1991 Stapleton et al. ..... 345/206
5,061,569 A 10/1991 VanSlyke et al.
5,157,525 A * 10/1992 Eaton et al. ..... 345/87
5,216,504 A 6/1993 Webb et al.
5,281,960 A 1/1994 Dwyer, III
5,428,370 A 6/1995 Knapp et al.
5,521,639 A 5/1996 Tomura et al.
5,592,215 A 1/1997 Kuga (Continued)

FOREIGN PATENT DOCUMENTS

EP 0923067 A1 6/1999

(Continued)

*Primary Examiner*—Richard Hjerpe
*Assistant Examiner*—Leonid Shapiro
(74) *Attorney, Agent, or Firm*—David A. Novais; Andrew J. Anderson; Stephen H. Shaw

(57) ABSTRACT

An organic light-emitting diode (OLED) display having addressable pixels on a substrate, the pixels having performance attributes, and a control circuit for controlling the pixels of the display device, includes one or more OLED pixels; an OLED reference pixel located on a substrate and connected to the control circuit, the OLED reference pixel having the same performance attributes as the one or more OLED pixels, the OLED reference pixel having a voltage sensing circuit including a transistor connected to one of the terminals of the OLED reference pixel for sensing the voltage across the OLED reference pixel to produce a voltage signal representing the voltage across the OLED reference pixel; a measurement circuit connected to the voltage signal to produce an output signal representative of the performance attributes of the OLED reference pixel; an analysis circuit connected to the measurement circuit to receive the output signal, compare the performance attributes with predetermined performance attributes, and produce a feedback signal in response thereto; and the control circuit being responsive to the feedback signal to compensate for changes in the output of the OLED pixels.

32 Claims, 5 Drawing Sheets

U.S. PATENT DOCUMENTS

| | | | | |
|---|---|---|---|---|
| 5,739,809 | A | 4/1998 | McLaughlin et al. | |
| 5,742,339 | A | 4/1998 | Wakui | |
| 5,910,792 | A | 6/1999 | Hansen et al. | |
| 6,057,924 | A | 5/2000 | Ross et al. | |
| 6,097,462 | A | 8/2000 | Koe | |
| 6,157,356 | A * | 12/2000 | Troutman | 345/82 |
| 6,229,508 | B1 | 5/2001 | Kane | |
| 6,329,758 | B1 | 12/2001 | Salam | |
| 6,344,930 | B1 | 2/2002 | Kaneko et al. | |
| 6,414,661 | B1 | 7/2002 | Shen et al. | |
| 6,423,900 | B1 * | 7/2002 | Soules | 174/66 |
| 6,456,016 | B1 | 9/2002 | Sundahl et al. | |
| 6,504,565 | B1 | 1/2003 | Narita et al. | |
| 6,518,962 | B2 * | 2/2003 | Kimura et al. | 345/211 |
| 6,608,439 | B1 * | 8/2003 | Sokolik et al. | 313/512 |
| 2002/0047550 | A1 | 4/2002 | Tanada | |
| 2002/0167474 | A1 | 11/2002 | Everitt | |
| 2002/0171611 | A1 | 11/2002 | Cok | |
| 2003/0122813 | A1 | 7/2003 | Ishizuki et al. | |
| 2004/0070558 | A1 | 4/2004 | Cok et al. | |
| 2004/0150594 | A1 | 8/2004 | Koyama et al. | |
| 2004/0222954 | A1 * | 11/2004 | Lueder | 345/87 |
| 2005/0280766 | A1 * | 12/2005 | Johnson et al. | 349/167 |
| 2006/0038758 | A1 * | 2/2006 | Routley et al. | 345/81 |

FOREIGN PATENT DOCUMENTS

| | | |
|---|---|---|
| EP | 1 079 361 | 2/2001 |
| EP | 1 091 339 | 4/2001 |
| EP | 1 158 483 | 11/2001 |
| JP | 04-269790 | 9/1992 |
| JP | 2002-169511 | 6/2002 |
| JP | 2002 278514 | 9/2002 |
| WO | 01/20591 | 3/2001 |

* cited by examiner

OLED DISPLAY WITH AGING COMPENSATION

This is a continuation-in-part of application U.S. Ser. No. 09/577,241 filed May 24, 2000 now abandoned.

FIELD OF THE INVENTION

The present invention relates to solid-state OLED flat-panel displays and more particularly to such displays having means to compensate for the aging of the organic light-emitting display.

BACKGROUND OF THE INVENTION

Solid-state organic light-emitting diode (OLED) displays are of great interest as a superior flat-panel display technology. These displays utilize current passing through thin films of organic material to generate light. The color of light emitted and the efficiency of the energy conversion from current to light are determined by the composition of the organic thin-film material. Different organic materials emit different colors of light. However, as the display is used, the organic materials in the display age and become less efficient at emitting light. This reduces the lifetime of the display. The differing organic materials may age at different rates, causing differential color aging and a display whose white point varies as the display is used.

The characteristics of a solid-state display are affected not only by its inherent technology and by the manufacturing processes and materials used to create it, but also by the way in which it is operated. The voltages supplied to the device, current available, the timing of various signal lines, the temperature of operation, etc. all affect the display characteristics.

Unfortunately, over time the characteristics of any display device can change. These changes can occur over a very short period of time (milliseconds) or over years. For example, when charge is stored at a pixel, the charge decays, affecting the brightness or color of the pixel. Alternatively, as time passes and a display device is used, the nature of the pixel can change: transistors become less efficient or responsive, impurities creep into display elements causing them to decrease in brightness or change in color, etc.

Referring to FIG. 7, a graph illustrating the typical light output of an OLED display as current is passed through the OLEDs is shown. The three curves represent typical performance of the different light emitters emitting differently colored light (e.g. R,G,B representing red, green and blue light emitters, respectively) as represented by luminance output over time or cumulative current. As can be seen by the curves, the decay in luminance between the differently colored light emitters can be different. The differences can be due to different aging characteristics of materials used in the differently colored light emitters, or due to different usages of the differently colored light emitters. Hence, in conventional use, with no aging correction, the display will become less bright and the color, in particular the white point, of the display will shift.

To some extent these changes can be ameliorated by modifying the operation of the device. For example, image information can be rewritten (refreshed) at each pixel site, operating voltages can be adjusted, more current can be made available, the timing of the control signals can be modified, data value to charge ratios can be changed, etc. In order to appropriately modify the operation of the device, however, the performance changes must be known.

One approach to compensating for uniformity and aging differences in a display is described in EP0923067 A1 by Kimura et al, and published 19990616. In this design a current measuring circuit is used to monitor the behavior of the display and the information used to modify the control of the display. In an alternative embodiment, a monitoring circuit is used to monitor the behavior of the display. In this design, complex current measuring circuits with comparators are necessary to provide useful information for modifying the control of the display.

U.S. Pat. No. 6,414,661 B1 issued Jul. 2, 2002 to Shen et al. describes a method and associated system that compensates for long-term variations in the light-emitting efficiency of individual organic light-emitting diodes (OLEDs) in an OLED display, by calculating and predicting the decay in light output efficiency of each pixel based on the accumulated drive current applied to the pixel and derives a correction coefficient that is applied to the next drive current for each pixel. This technique requires the measurement and accumulation of drive current applied to each pixel, requiring a stored memory that must be continuously updated as the display is used, requiring complex and extensive circuitry.

U.S. Patent Application 2002/0167474 A1 by Everitt, published Nov. 14, 2002, describes a pulse width modulation driver for an OLED display. One embodiment of a video display comprises a voltage driver for providing a selected voltage to drive an organic light-emitting diode in a video display. The voltage driver may receive voltage information from a correction table that accounts for aging, column resistance, row resistance, and other diode characteristics. In one embodiment of the invention, the correction tables are calculated prior to and/or during normal circuit operation. Since the OLED output light level is assumed to be linear with respect to OLED current, the correction scheme is based on sending a known current through the OLED diode for a duration sufficiently long to allow the transients to settle out and then measuring the corresponding voltage with an analog-to-digital converter (A/D) residing on the column driver. A calibration current source and the A/D can be switched to any column through a switching matrix. This design requires the use of an integrated, calibrated current source and A/D converter, greatly increasing the complexity of the circuit design.

U.S. Pat. No. 6,504,565 B1 issued Jan. 7, 2003 to Narita et al., describes a light-emitting display which includes a light-emitting element array formed by arranging a plurality of light-emitting elements, a driving unit for driving the light-emitting element array to emit light from each of the light-emitting elements, a memory unit for storing the number of light emissions for each light-emitting element of the light-emitting element array, and a control unit for controlling the driving unit based on the information stored in the memory unit so that the amount of light emitted from each light-emitting element is held constant. An exposure display employing the light-emitting display, and an image forming apparatus employing the exposure display are also disclosed. This design requires the use of a calculation unit responsive to each signal sent to each pixel to record usage, greatly increasing the complexity of the circuit design.

JP 2002278514 A by Numeo Koji, published Sep. 27, 2002, describes a method in which a prescribed voltage is applied to organic EL elements by a current-measuring circuit and the current flows are measured; and a temperature measurement circuit estimates the temperature of the organic EL elements. A comparison is made with the voltage value applied to the elements, the flow of current values and the estimated temperature, the changes due to aging of similarly constituted elements determined beforehand, the changes due to aging in the current-luminance characteristics and the temperature at the time of the characteristics measurements for estimating the current-luminance characteristics of the elements. Then, the total sum of the amount of currents being supplied to the elements in the interval during which display data are displayed, is changed so as to obtain the luminance that is to be originally displayed, based on the estimated values of the current-luminance characteristics, the values of the current flowing in the elements, and the display data.

Published US Patent No. US20030122813 A1 entitled "Panel display driving display and driving method" by Ishizuki et al published 20030703 discloses a display panel driving device and driving method for providing high-quality images without irregular luminance even after long-time use. The value of the light-emission drive current flowing when causing each light-emission elements bearing each pixel to independently emit light in succession is measured, then the luminance is corrected for each input pixel data based on the above light-emission drive current values, associated with the pixels corresponding to the input pixel data. According to another aspect, the voltage value of the drive voltage is adjusted in such a manner that one value among each measured light-emission drive current value becomes equal to a predetermined reference current value. According to a further aspect, the current value is measured while an off-set current component corresponding to a leak current of the display panel is added to the current outputted from the drive voltage generator circuit and the resultant current is supplied to each of the pixel portions.

This design presumes an external current detection circuit sensitive enough to detect the relative current changes in a display due to a single pixel's power usage. Such circuits are difficult to design and expensive to build. Moreover, the measurement techniques are iterative and therefore slow and rely upon a voltage source drive while OLED displays are preferably controlled using constant current sources.

There is a need therefore for an improved aging compensation approach for organic light-emitting diode display.

SUMMARY OF THE INVENTION

The need is met according to the present invention by providing an organic light-emitting diode (OLED) display having addressable pixels on a substrate, the pixels having performance attributes, and a control circuit for controlling the pixels of the display device, that includes one or more OLED pixels; an OLED reference pixel located on a substrate and connected to the control circuit, the OLED reference pixel having the same performance attributes as the one or more OLED pixels, the OLED reference pixel having a voltage sensing circuit including a transistor connected to one of the terminals of the OLED reference pixel for sensing the voltage across the OLED reference pixel to produce a voltage signal representing the voltage across the OLED reference pixel; a measurement circuit connected to the voltage signal to produce an output signal representative of the performance attributes of the OLED reference pixel; an analysis circuit connected to the measurement circuit to receive the output signal, compare the performance attributes with predetermined performance attributes, and produce a feedback signal in response thereto; and the control circuit being responsive to the feedback signal to compensate for changes in the output of the OLED pixels.

ADVANTAGES

The advantages of this invention are an OLED display that compensates for the aging of the organic materials in the display without requiring extensive or complex circuitry and control and uses simple voltage measurement circuitry.

DETAILED DESCRIPTION OF THE INVENTION

The present invention describes a display that overcomes the problems in the prior art through the use of reference pixels to enable the measurement of pixel performance and a feedback mechanism responsive to the measured pixel performance to modify the operating characteristics of the display device. These operational changes improve the performance of the display device.

The solid-state image display device with a reference pixel is composed of a standard, solid-state display device having an array or collection of pixels supplemented by an additional reference pixel or pixels that have the same performance attributes as the pixels in the display device. According to a preferred embodiment of the invention, the pixels are OLEDs having a local charge storage mechanism and a transistor drive circuit activated by the stored charge for applying power to each pixel. The reference pixels can be instrumented with a voltage measurement circuit that is connected to an analysis circuit that produces a feedback signal which is in turn supplied to a control circuit that controls the operation of the display device and the reference pixel.

Figure 1:
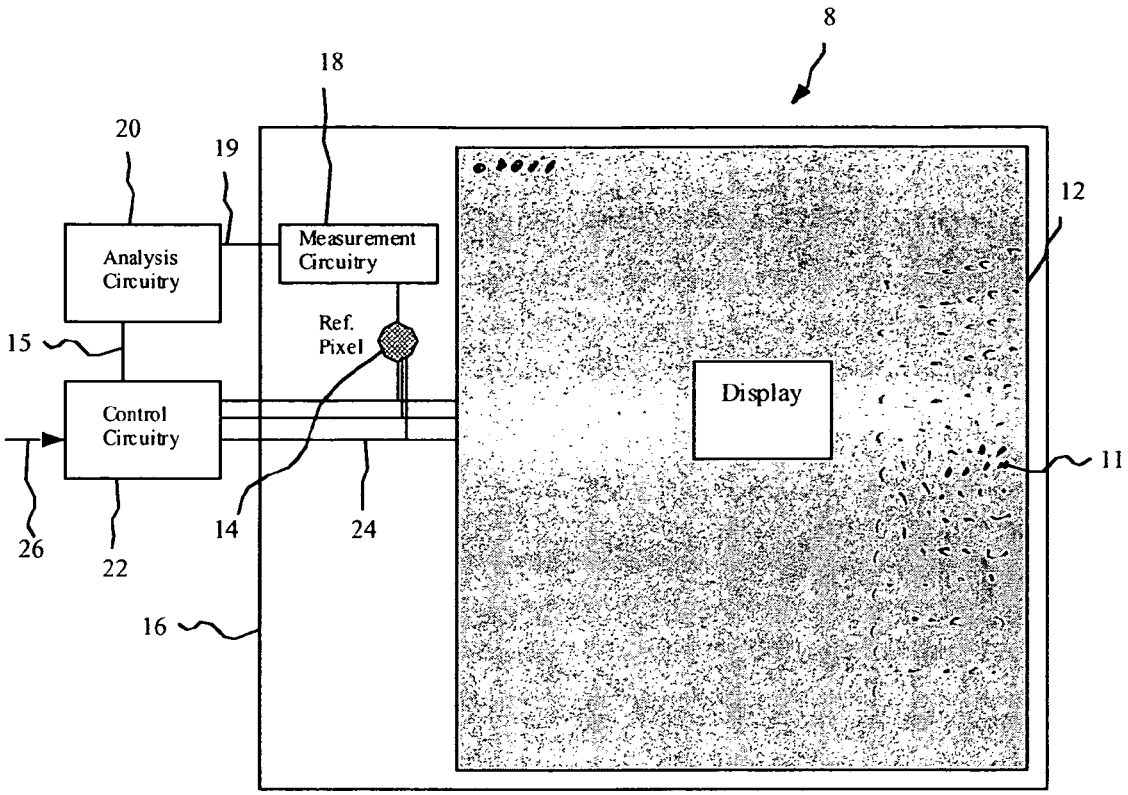
FIG. 1 is a schematic diagram of an OLED display with feedback and control circuits according to one embodiment of the present invention.

Referring to FIG. 1 an organic light-emitting diode display system 8 includes a display 12 having an array of light emitters 11 with an additional reference pixel 14 on a common substrate 16. The characteristics of the reference pixel 14 are measured by a measurement circuit 18 and the information gathered thereby is connected to an analysis circuit 20. The analysis circuit 20 produces a feedback signal 15 that is supplied to a control circuit 22. The control circuit 22 is responsive to input signal 26 and feedback signal 15. The control circuit 22 modifies the input signals 26 to compensate for changes in the operating characteristics of the image display and supplies the corrected control signals 24 to the display. Circuitry (not shown) on the substrate 16 for driving the light emitters in the array 11, for example transistors and capacitors, may be provided and are well known in the art, as are suitable control circuits 22. Note that for clarity, the various elements are not shown to scale. In actual practice, the reference pixel 14 would be far smaller than the display device, as would the measurement circuit 18.

The display 12 is conventional. Control signals, power, etc. are all supplied as is well-known in the art, with the addition that the control circuit 22 can modify the control and/or power signals in response to the feedback signal 15. The display system 8 operates as follows. When the display 12 is energized and information is written to the display thereby causing the display to display an image, the reference pixel 14 is likewise energized in a known manner (for example one half, full on, or an estimated average of the display information) by the control circuit 22. The energy, control, and information written to the reference pixel 14 are chosen to represent the performance of the display 12 insofar as is possible. In particular, the reference pixel 14 could be operated in such a way as to represent an average pixel or a worst-case pixel, depending on the desires of the system designer. Those aspects of the system design of the most concern or having the worst performance might be carefully recreated in the reference pixel.

OLED light-emitting elements emit light in proportion to the current that passes through them. Current is typically supplied by providing a voltage differential across the terminals of the OLED, generally through a transistor amplifier responding to stored charge (in an active-matrix design) or directly to an analog voltage supplied through signal lines (in a passive-matrix design). The amount of current passing through the OLED will depend upon the voltage applied and the effective resistance of the OLED. As is known, the aging of the OLEDs is related to the cumulative current passed through the OLED resulting in reduced performance. Applicants have also determined that the aging of the OLED material results in an increase in the apparent resistance of the OLED that causes a decrease in the current passing through the OLED at a given voltage. The decrease in current is directly related to the decrease in luminance of the OLED at a given voltage. In addition to the OLED resistance changing with use, the light-emitting efficiency of the organic materials is reduced. As the light-emitting materials age, the effective resistance increases, decreasing the current flow and the consequent light output, and increasing the voltage drop across the OLED. Hence, problems with aging materials in an OLED can be detected by measuring the voltage and/or voltage variability across the OLED.

By measuring the luminance decrease and its relationship to the decrease in voltage across an OLED, a change in corrected control signal 24 necessary to cause the OLED light-emitting element 10 to output a nominal luminance for a given input signal 26 may be determined. These changes can be applied by the control circuit 22 to correct the light output to the nominal luminance value desired. By correcting the input signal applied to the OLED light emitters, changes due to aging in the OLED display can be compensated.

Once the reference pixel 14 is operational, the measurement circuit 18 monitors the voltage drop across an OLED light-emitting element in the reference pixel 14. The measured voltage drop is compared to the expected or desired voltage drop by the analysis circuit 20. The comparison can be based on a priori knowledge of the characteristics of the OLED, simply compared to some arbitrary value empirically shown to give good performance, or to a voltage history. In any case, once a determination is made that the performance of the reference OLED has changed, the analysis circuitry 20 provides a feedback signal 15 to control circuit 22. The control circuit 22 then provides corrected control signals 24 to the display 12.

Care should be taken to ensure that the corrections provided by control circuit 22 are kept within sensible bounds and that uncontrolled positive feedback does not occur. For example, if brightness declines over time and increased voltage improves brightness, some limit to the possible voltage applied to the device should be set to prevent dangerous or damaging conditions from occurring.

Figure 2:
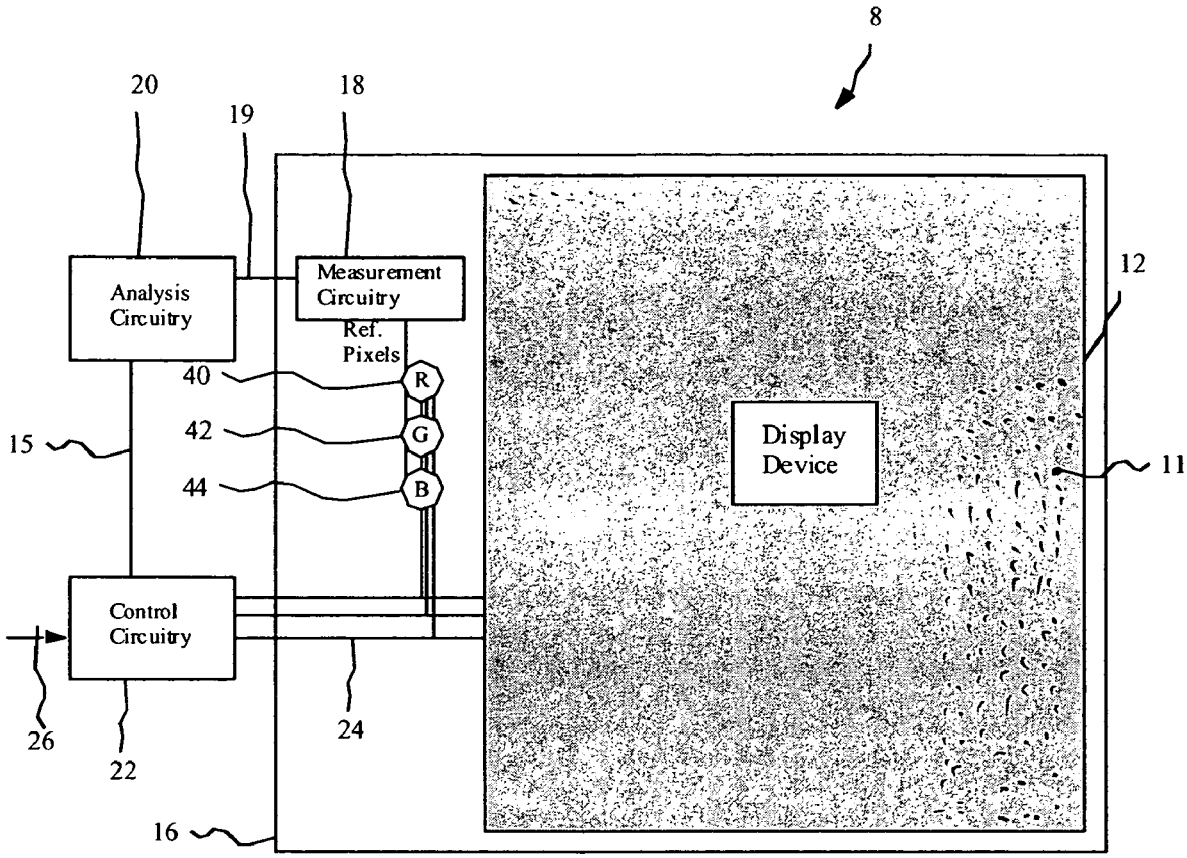
FIG. 2 is a schematic diagram an OLED display having a plurality of OLED reference pixels according to another embodiment of the present invention.

Referring to FIG. 2, in addition to the single reference pixel shown in FIG. 1, a plurality of reference pixels could be used. For example the pixels in the display device 12 can include red, green and blue colored subpixels. If the operational or display characteristics of the various colored subpixels differ, it can be useful to include a reference pixel 40, 42, 44 corresponding to each color. Indeed, one can generally include a reference pixel for each type of pixel for which a measurement is desired. The measurement and operational approach described is identical in these cases but the feedback correction derived from each reference pixel is applied only to the control signals for the pixels of the corresponding type.

Multiple, identical reference pixels can be used as well. Their outputs can be combined to provide an overall feedback signal less subject to noise, process variation, and failure. It is also possible to have reference pixels associated with specific portions of the display or to use actual display pixels as reference pixels.

The measurement and analysis circuitry can be integrated directly onto the same substrate as the display device or it can be implemented externally to the display. The measurement and/or analysis circuitry can also be integrated directly into the control circuit 22. Alternatively, the analysis circuit may be implemented in software in the control circuit 22. In general, higher performance and greater accuracy can be achieved by integrating the circuitry directly with the reference pixels but this may not be desirable for all display devices. (For example, the pixel technology and manufacturing process may inhibit the integration of measurement circuitry and logic.) Voltage measurements are much simpler than alternative measurements, such as current measurement or optical feedback described in the prior art, and can be readily integrated onto display substrates, for example glass, using conventional thin-film transistors.

This concept can be extended to the analysis and even the feedback control circuitry 22. These may also be integrated in various ways on the display substrate 16 itself. System issues such as power, the implementation of control and timing logic, etc., and the effective integration of the various functions in the system will dictate the best approach.

Figure 3:
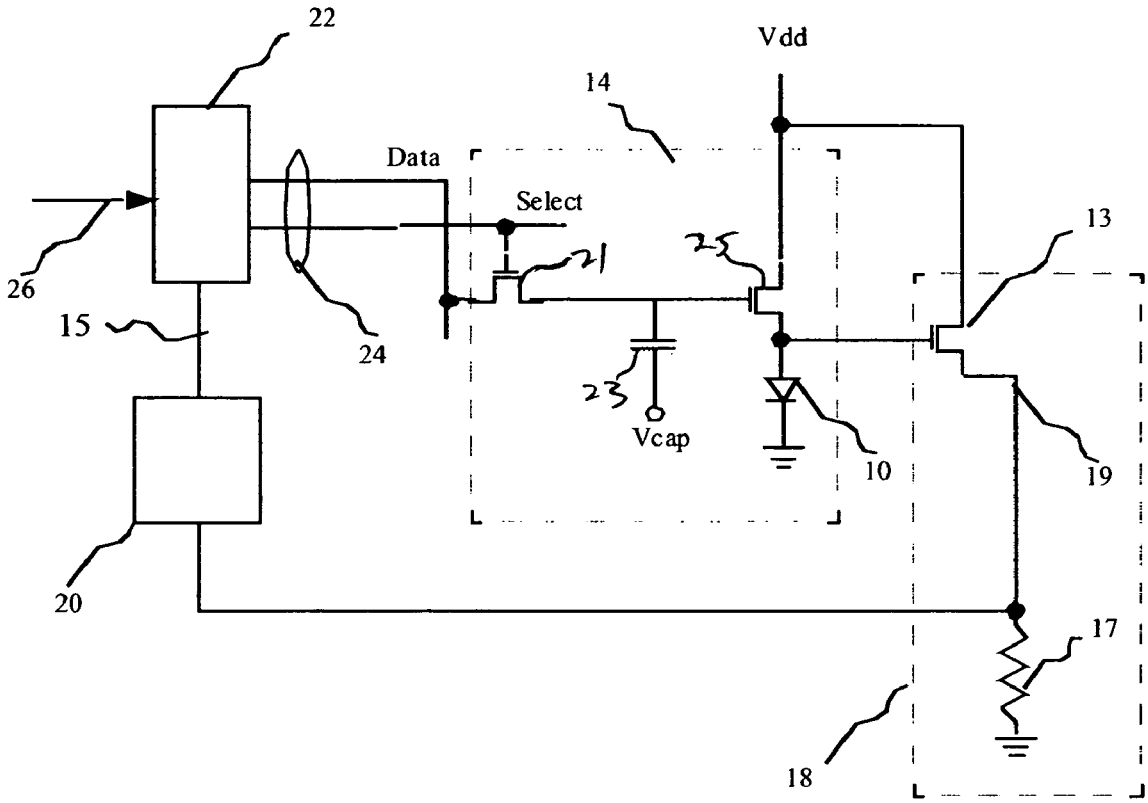
FIG. 3 is a circuit diagram of an OLED reference pixel according to one embodiment of the present invention.

Referring to FIG. 3, an organic light-emitting diode (OLED) reference pixel 14 according to one embodiment of the present invention comprises a select transistor 21, a storage capacitor 23, a driving transistor 25, and an OLED light-emitting element 10. A measurement circuit 18 for sensing voltage across the OLED to produce a signal 19 representing the voltage includes a measuring transistor 13 for driving current through a load resistor 17. An analysis circuit 20 provides a feedback signal 15 to the control circuit 22 for controlling the organic light-emitting diode display and responsive to the feedback signal 15 for calculating a corrected control signal 24, and applying the corrected control signal 24 to the OLED display that compensates for the changes in the light output of the reference pixel 14. The load resistor 17 is connected between the transistor 13 and ground generates a voltage proportional to the voltage across OLED 10.

Figure 4:
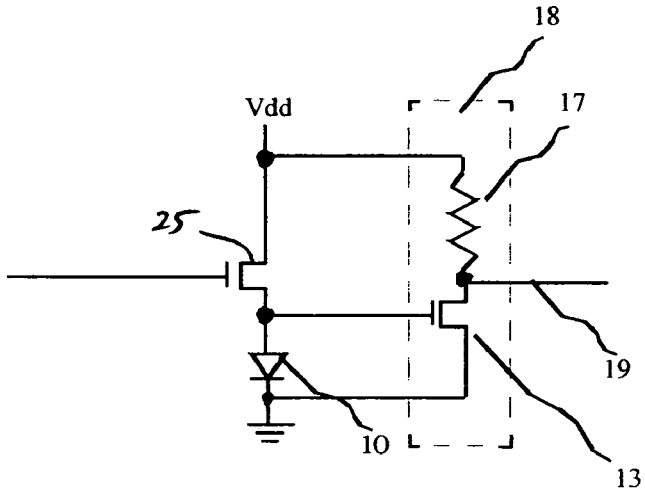
FIG. 4 is an alternative circuit diagram of an OLED reference pixel according to one embodiment of the present invention.

FIG. 4 illustrates an alternate configuration of the voltage sensor 17. In this embodiment, the load resistor 17 is connected to a power Vdd line rather than the ground. The load resistor 17 may be provided in a variety of locations, including in the control circuit 22 or analysis circuit 20. In the embodiments shown in FIGS. 1 and 2, a separate output line 19 is connected from each measurement circuit 18 and employed to provide a separate feedback signal 15 for each reference pixel 14 that is to be measured.

According to the present invention, the control circuit 22 includes means to selectively activate all of the light emitters 11 in the display 12 corresponding to a reference pixel 14 and responds to the feedback signal 15 for calculating a correction signal for the selectively activated light-emitting elements 11. The control circuit 22 is responsive to the input signals 26 and the feedback signal 15 to produce corrected control signals 24 that compensate for the changes in the output of the selectively activated light emitters.

Figure 5:
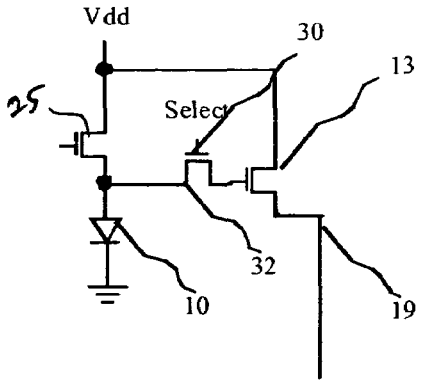
FIG. 5 is a further alternative circuit diagram of an OLED reference pixel according to one embodiment of the present invention.

As shown in FIG. 5, an alternative means for controlling the output of the measured signal 19 to the control circuit 22 may be used, for example with a select signal 30 and select transistor 32. This alternative is useful when a plurality of reference pixels 14 are employed. In this embodiment, a separate connection to each reference pixel 14 is not required.

Figure 6:
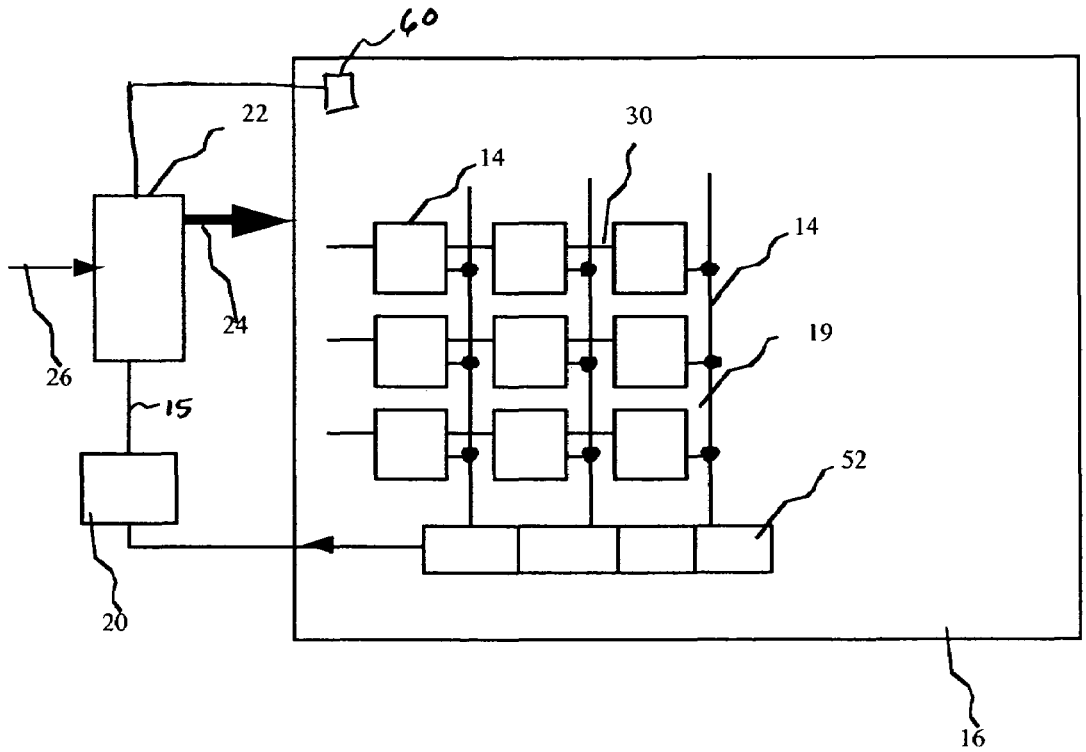
FIG. 6 is a schematic diagram of an OLED display having a plurality of OLED reference pixels according to yet another embodiment of the present invention.
Figure 7:
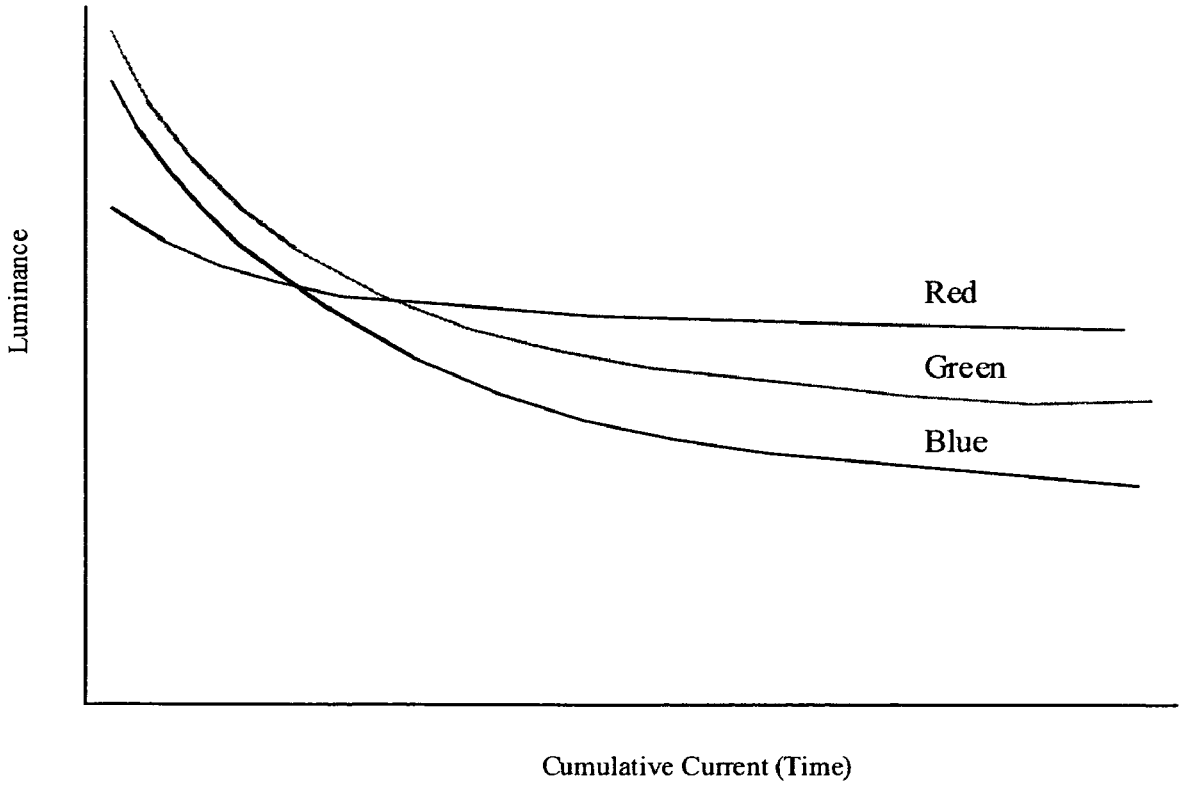
FIG. 7 is a diagram illustrating the aging of OLED displays.

Referring to FIG. 6, a plurality of reference pixels 14 may be arranged in groups (for example rows or columns) having measured signal outputs 19 combined on a single line, thereby making this embodiment practical for displays having larger numbers of reference pixels (for example, one per row or column). In this arrangement, a plurality of reference pixels 14 may be energized and selected simultaneously. The feedback signal 19 for each group can be deposited into an analog shift register 52 and clocked out of the display using means well known in the art. Such an approach may also be readily applied to reducing the number of signal lines employed for multiple reference pixel designs, for example as shown in FIG. 2. Other circuit elements such as multiplexers may be employed to output the feed back signals 19 from a plurality of reference pixels 14. It is also possible to energize only one reference pixel 14 within each group having a common measured signal line 19 thereby providing a feedback signal from individual reference pixels whose measured outputs are connected in common.

In one embodiment, the present invention may be applied to a color image display comprising an array of pixels, each pixel including a plurality of different colored light-emitting elements (e.g. red, green and blue) that are individually controlled by the control circuit to display a color image. The colored light-emitting elements may be formed by different organic light-emitting materials that emit light of different colors, alternatively, they may all be formed by the same organic white light-emitting materials with color filters over the individual elements to produce the different colors. In another embodiment, the pixels are individual graphic elements within a display and may not be organized in a regular array. In either embodiment, the light-emitting elements may have either passive- or active-matrix control and may either have a bottom-emitting or top-emitting architecture.

The present invention can be constructed simply, requiring only (in addition to a conventional display control circuit) a voltage measurement circuit, an additional line to each OLED or column of OLEDs, a transformation means for the model to perform the signal correction (for example a lookup table or amplifier), and a calculation circuit to determine the correction for the given input signal. No current accumulation or time information is necessary. Moreover, these corrections may be made continuously and do not inhibit the operation of the display.

The present invention may be extended to include complex relationships between the corrected image signal, the measured voltage, and the aging of the materials. Multiple input signals may be used corresponding to a variety of reference pixel luminance outputs. For example, a different input signal may correspond to each output brightness level. When calculating the correction signals, a separate correction signal may be obtained for each reference pixel output brightness level having different given input signals. A separate correction signal is then employed for each display output brightness level required. As described above, this can be done for each light emitter grouping, for example different light emitter color groups. Hence, the correction signals may correct for each display output brightness level for each color as each material ages.

The correction calculation process may be performed continuously or periodically during use, at power-up or power-down. Alternatively, the correction calculation process may be performed in response to a user signal supplied to the control circuit.

OLED displays dissipate significant amounts of heat and become quite hot when used over long periods of time. Further experiments by applicant have determined that there is a strong relationship between temperature and current used by the displays. As shown in FIG. 6 a temperature sensor 60 can be provided on the display. The output of the temperature sensor is supplied to control circuit 22. Therefore, if the display has been in use for a period of time, the temperature of the display may need to be taken into account in calculating the corrected control signals 24. If it is assumed that the display has not been in use, or if the display is cooled, it may be assumed that the display is at a predetermined ambient temperature, for example room temperature. If the correction signal model was determined at that temperature, the temperature relationship may be ignored. If the display is calibrated at power-up and the correction signal model was determined at ambient temperature, this is a reasonable presumption in most cases. For example, mobile displays with a relatively frequent and short usage profile might not need temperature correction. Display applications for which the display is continuously on for longer periods, for example, monitors, televisions, or lamps might require temperature accommodation, or can be corrected on power-up to avoid display temperature issues.

If the display is calibrated at power-down, the display may be significantly hotter than the ambient temperature and it is preferred to accommodate the calibration by including the temperature effect. This can be done by measuring the temperature of the display, for example with a thermocouple placed on the substrate or cover of the display, or a temperature sensing element 60, such as a thermistor, integrated into the electronics of the display. For displays that are constantly in use, the display is likely to be operated significantly above ambient temperature and the temperature can be taken into account for the display calibration.

To further reduce the possibility of complications resulting from inaccurate current readings or inadequately compensated display temperatures, changes to the correction signals applied to the input signals may be limited by the control circuit. Any change in correction can be limited in magnitude, for example to a 5% change. A calculated correction signal might also be restricted to be monotonically increasing, since the aging process does not reverse. Correction changes can also be averaged over time, for example an indicated correction change can be averaged with the previous value(s) to reduce variability. Alternatively, an actual correction can be made only after taking several readings, for example, every time the display is powered on, a corrections calculation is performed and a number of calculated correction signals (e.g. 10) are averaged to produce the actual correction signal that is applied to the display.

The corrected control signal 24 may take a variety of forms depending on the OLED display. For example, if analog voltage levels are used to specify the signal, the correction will modify the voltages of the signal. This can be done using amplifiers as is known in the art. In a second example, if digital values are used, for example corresponding to a charge deposited at an active-matrix light-emitting element location, a lookup table may be used to convert the digital value to another digital value as is well known in the art. In a typical OLED display, either digital or analog video signals are used to drive the display. The actual OLED may be either voltage- or current-driven depending on the circuit used to pass current through the OLED. Again, these techniques are well known in the art and the present invention accommodates either drive scheme.

The correction used to modify the input image signal to form corrected control signals may be used to implement a wide variety of display performance attributes over time. For example, the model used to apply corrections to an input image signal may hold the average luminance or white point of the display constant. Alternatively, the corrections used to create the corrected control signals may allow the average luminance to degrade more slowly than it would otherwise due to aging.

In a preferred embodiment, the invention is employed in a device that includes Organic Light-emitting Diodes (OLEDs), which are composed of small molecule or polymeric OLEDs, as disclosed in, but not limited to, U.S. Pat. No. 4,769,292, issued Sep. 6, 1988 to Tang et al., entitled "Electroluminescent Device with Modified Thin Film Luminescent Zone" and U.S. Pat. No. 5,061,569, issued Oct. 29, 1991 to VanSlyke et al., entitled "Electroluminescent Device with Organic Electroluminescent Medium". Many combinations and variations of OLED can be used to fabricate such a device. OLED devices can be integrated in a micro-circuit on a conventional silicon substrate 10 and exhibit the necessary characteristics. Alternatively, OLED devices may also be integrated upon other substrates, such as glass or steel having a pattern of conductive oxide and amorphous, polycrystalline, or continuous grain silicon material deposited thereon. The deposited silicon materials may be single-crystal in nature or be amorphous, polycrystalline, or continuous grain. These deposited materials and substrates are known in the prior art and this invention, and may be applied equally to any micro-circuit integrated on a suitable substrate.

Hence, as taught in this invention, the integration of reference pixels, the measurement of their performance, and appropriate feedback to the control of the display device can enhance the image quality, lifetime, and power consumption of a digital image display system.

The invention has been described in detail with particular reference to certain preferred embodiments thereof, but it will be understood that variations and modifications can be effected within the spirit and scope of the invention.

| PARTS LIST | |
|---|---|
| 10 | OLED light-emitting element |
| 11 | pixel |
| 12 | display |
| 13 | transistor |
| 14 | reference pixel |
| 15 | feedback signal |
| 16 | substrate |
| 17 | load resistor |
| 18 | measurement circuit |
| 19 | signal |
| 20 | analysis circuit |
| 21 | select transistor |
| 22 | control circuit |
| 23 | storage capacitor |
| 24 | corrected signals |
| 25 | driving transistor |
| 26 | input signals |
| 30 | select signal |
| 32 | select transistor |
| 52 | shift register |
| 60 | temperature sensor |

What is claimed is:

1. An organic light-emitting diode (OLED) display system having addressable pixels on a substrate, the pixels having performance attributes, and a control circuit for controlling the pixels of the display device, comprising:

a) an array of OLED pixels forming a display device;

b) an additional OLED reference pixel external to the display device and located on a common substrate with the display device, and connected to the control circuit, the additional OLED reference pixel having the same performance attributes as the OLED pixels, the additional OLED reference pixel having a voltage sensing circuit including a transistor connected to one of the terminals of the additional OLED reference pixel for sensing the voltage across the additional OLED reference pixel to produce a voltage signal representing the voltage across the additional OLED reference pixel;

c) a measurement circuit connected to the voltage signal that represents the voltage across the additional OLED reference pixel to produce an output signal representative of the performance attributes of the additional OLED reference pixel;

d) an analysis circuit connected to the measurement circuit to receive the output signal, compare the performance attributes with predetermined performance attributes, and produce a feedback signal in response thereto; and e) the control circuit being responsive to the feedback signal to compensate for changes in the output of the array of OLED pixels.

2. The OLED display system claimed in claim 1, wherein the output of the array of OLED pixels changes with temperature, and further comprising a temperature sensor for generating a temperature signal and wherein the control circuit is also responsive to the temperature signal to calculate the correction signal.

3. The OLED display system claimed in claim 1, wherein the control circuit further includes a lookup table containing corrected control signals for controlling the pixels of the display.

4. The OLED display system claimed in claim 1, further comprising a plurality of additional OLED reference pixels and measurement circuits connected to the analysis circuit.

5. The OLED display system claimed in claim 4, wherein the OLED display includes different types of OLED pixels in the array having different performance attributes and the additional OLED reference pixels include a pixel of each of the different type.

6. The OLED display system claimed in claim 5, wherein the types of OLED pixels in the array include OLED pixels of different colors.

7. The OLED display system claimed in claim 4, wherein the additional OLED reference pixels include multiple identical OLED reference pixels whose results are combined whereby the measured performance attribute is more accurately measured.

8. The OLED display system claimed in claim 1, wherein the analysis circuit compares the additional OLED reference pixel performance attributes to a model of OLED pixel behavior.

9. The OLED display system claimed in claim 1, wherein the analysis circuit compares the additional OLED reference pixel attributes to empirical data relating to the performance of an exemplary OLED display.

10. The OLED display system claimed in claim 1, wherein the analysis device compares the additional OLED reference pixel attributes to historical OLED reference pixel attribute data.

11. The OLED display system claimed in claim 1, wherein the measurement circuit is integrated on the same substrate as the additional OLED reference pixel.

12. The OLED display system claimed in claim 1, wherein the analysis circuit is integrated on the same substrate as the additional OLED reference pixel.

13. The OLED display system claimed in claim 1, wherein the feedback control circuit is integrated on the same substrate as the additional OLED reference pixel.

14. The OLED display system claimed in claim 1, wherein the control circuit controls the voltage applied to the entire display device.

15. The OLED display system claimed in claim 1, wherein the control circuit controls the voltage applied to groups of OLED pixels in the array on the OLED display.

16. The OLED display system claimed in claim 1, wherein the control circuit modifies a response to code values used to represent OLED pixel brightness.

17. The OLED display system claimed in claim 1, wherein the control circuit controls the time that voltage or charge is applied to the array of OLED pixels in the OLED display.

18. A method for controlling an OLED display device having an array of addressable OLED pixels on a substrate, the OLED pixels having performance attributes, and a control circuit for controlling the array of OLED pixels of the OLED display, comprising the steps of:

a) providing an additional OLED reference pixel, external to the display device, and located on the substrate and connected to the control circuit, the additional OLED reference pixel having the same performance attributes as the OLED pixels in the array, the additional OLED reference pixel having a voltage sensing circuit including a transistor connected to one of the terminals of the additional OLED reference pixel for sensing the voltage across the additional OLED reference pixel to produce a voltage signal representing the voltage across the additional OLED reference pixel;

b) measuring the voltage signal to produce an output signal representative of the performance attributes of the additional OLED reference pixel;

c) receiving the output signal, comparing the performance attributes with predetermined performance attributes, and producing a feedback signal in response thereto; and d) controlling the OLED display in response to the feedback signal by calculating a corrected control signal for controlling the OLED pixels in the array and employing the corrected control signal to control the OLED pixels in the array to thereby compensate for the changes in the output of the OLED pixels in the array.

19. The method claimed in claim 18, further comprising the steps of providing a plurality of additional OLED reference pixels and measuring the outputs thereof.

20. The method claimed in claim 19, wherein the OLED display includes different types of OLED pixels in the array having different performance attributes and the additional OLED reference pixels include a pixel of each different type.

21. The method claimed in claim 18, wherein the types of OLED pixels in the array include pixels of different colors.

22. The method claimed in claim 18, wherein the additional OLED reference pixels include multiple identical pixels whose results are combined whereby the measured performance attribute is more accurately measured.

23. The method claimed in claim 18, wherein the analyzing step includes comparing the additional OLED reference pixel performance attributes to a model of OLED pixel behavior.

24. The method claimed in claim 18, wherein the analyzing step includes comparing the additional OLED reference pixel attributes to empirical data relating to the performance of an exemplary OLED display.

25. The method claimed in claim 18, wherein the analyzing step includes comparing the additional OLED reference pixel attributes to historical reference OLED pixel attribute data.

26. The method claimed in claim 18, wherein the measuring step is performed with a measuring circuit that is integrated on the same substrate as the additional OLED reference pixel.

27. The method claimed in claim 18, wherein the analyzing step is performed with an analysis circuit that is integrated on the substrate.

28. The method claimed in claim 18, wherein the controlling step is performed by a control circuit that is integrated on the substrate.

29. The method claimed in claim 18, wherein the controlling step includes controlling the voltage applied to the entire OLED display.

30. The method claimed in claim 18, wherein the controlling step includes controlling the voltage applied to groups of OLED pixels in the array on the OLED display.

31. The method claimed in claim 18, wherein the controlling step includes modifying the response to code values used to represent OLED pixel brightness.

32. The method claimed in claim 18, wherein the controlling step includes controlling the time that voltage or charge is applied to the OLED pixels in the array.

* * * * *